US010902836B2

(12) United States Patent
Pognon et al.

(10) Patent No.: US 10,902,836 B2
(45) Date of Patent: Jan. 26, 2021

(54) DEVICE FOR ACTIVE CONTROL OF SOUND INSULATION IN AN AUTONOMOUS VEHICLE PASSENGER COMPARTMENT

(71) Applicant: PSA AUTOMOBILES SA, Poissy (FR)

(72) Inventors: Jean Luc Pognon, Puteaux (FR); Saran Diakite Kaba, Bievres (FR); Franck Brevet, Le Chesnay (FR); Sandrine Delenne, Palaiseau (FR); Virgile Charton, Paris (FR)

(73) Assignee: PSA AUTOMOBILES SA, Poissy (FR)

( * ) Notice: Subject to any disclaimer, the term of this patent is extended or adjusted under 35 U.S.C. 154(b) by 0 days.

(21) Appl. No.: 16/500,026

(22) PCT Filed: Mar. 23, 2018

(86) PCT No.: PCT/FR2018/050716
§ 371 (c)(1),
(2) Date: Oct. 1, 2019

(87) PCT Pub. No.: WO2018/185395
PCT Pub. Date: Oct. 11, 2018

(65) Prior Publication Data

US 2020/0168200 A1 May 28, 2020

(30) Foreign Application Priority Data

Apr. 4, 2017 (FR) ..... 17 52910

(51) Int. Cl.
*G10K 11/178* (2006.01)

(52) U.S. Cl.
CPC .... *G10K 11/178* (2013.01); *G10K 2210/1282* (2013.01)

(58) Field of Classification Search
CPC ..... G10K 11/178; G10K 2210/1282; G10K 2210/3211; G10K 11/17883; G10K 2210/128
(Continued)

(56) References Cited

U.S. PATENT DOCUMENTS

2012/0230504 A1 9/2012 Kuroda
2012/0257763 A1 10/2012 Bowden et al.
(Continued)

FOREIGN PATENT DOCUMENTS

WO 2007063467 A2 6/2007

OTHER PUBLICATIONS

International Search Report for PCT/FR2018/050716 dated Jul. 6, 2018.

*Primary Examiner* — Vivian C Chin
*Assistant Examiner* — Douglas J Suthers
(74) *Attorney, Agent, or Firm* — Sandberg Phoenix & von Gontard, P C.

(57) ABSTRACT

A control device (DC) is fitted to a vehicle (VA) which can be driven by a driver during a manual driving phase and which comprises a passenger compartment (H) fitted with a loudspeaker (HP) capable of diffusing sound signals and an assistance device (DA) for driving said vehicle in a totally autonomous manner during an autonomous driving phase. This device (DC) comprises acquisition means (MA) for recording first sound signals present in the external environment of the vehicle (VA), and control means (MC) for generating, during an autonomous driving phase, second sound signals in phase opposition to the first recorded sound signals, in order to supply same to the loudspeaker (HP) so that the transmission of said signals induces cancellation of the first sound signals in the passenger compartment (H).

9 Claims, 1 Drawing Sheet

(58) Field of Classification Search
USPC ..... 381/71.8
See application file for complete search history.

(56) References Cited

U.S. PATENT DOCUMENTS

| | | | | |
|---|---|---|---|---|
| 2015/0030175 | A1 | 1/2015 | Roggenkamp et al. | |
| 2018/0190258 | A1* | 7/2018 | Mohammad ..... | G10K 11/17883 |
| 2018/0284759 | A1* | 10/2018 | Michalakis ..... | G05D 1/0061 |

* cited by examiner

FIG.1
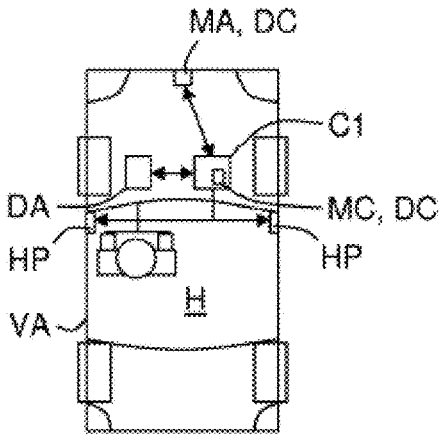
LEGEND
C1=Computer
DA=Assistance Device
DC=Control device
H=Passenger Compartment
HP=Loudspeaker
MA=Acquisition means
MC=Control means
VA=Vehicle
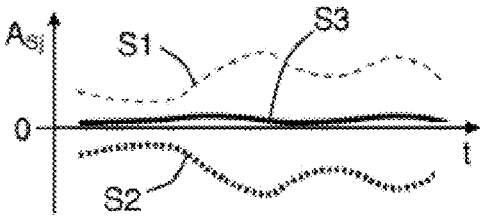
FIG.2
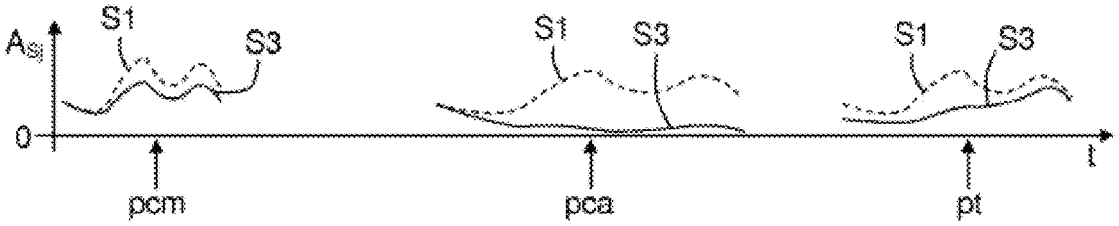
FIG.3

DEVICE FOR ACTIVE CONTROL OF SOUND INSULATION IN AN AUTONOMOUS VEHICLE PASSENGER COMPARTMENT

CROSS-REFERENCE TO RELATED APPLICATIONS

This application is the US National Stage under 35 USC § 371 of International Application No. PCT/FR2018/050716, filed 23 Mar. 2018 which claims priority to French Application No. 1752910 filed 4 Apr. 2017, both of which are incorporated herein by reference.

BACKGROUND

The invention relates to vehicles, such as an automobile, with autonomous control, and, more precisely, to the control of audible sounds in the passenger compartments of such vehicles.

Vehicles with autonomous control (or more simply autonomous vehicles), generally of the automotive kind, comprise an assistance device that is responsible for driving them without an operator driving them. Some of the autonomous vehicles can be optionally driven by the operator during a manual control phase, or in a completely autonomous manner during an autonomous control phase, there being a transition phase occurring between an autonomous control phase and a manual control phase.

During an autonomous control phase, it is the assistance device which is fully in control of the operation of the vehicle, regardless of whether or not there is a driver in the vehicle. During a transition phase between an autonomous control phase and a manual control phase, the driver again takes complete control of operating the vehicle after requesting control of the vehicle (for example visually or by sound), and the assistance device thus stops controlling the vehicle. During a transition phase between a manual control phase and an autonomous control phase, the assistance device takes control of the driving and the driver thus stops controlling the vehicle depending on the level of automation.

When a vehicle under autonomous control is in a (completely) autonomous control phase, its driver can do whatever he wants, and in particular rest, read, work, telephone, converse or eat. In these situations, it frequently happens that the driver wants peace and quiet in the passenger compartment. But such peace and quiet is very seldom present because of the many sounds generated in the environment outside of his vehicle. Consequently, the driver generally does not benefit entirely from the advantages conferred by an autonomous control phase.

It was proposed, in particular in the US Pub. No. 2015/0030175, to detect the state of the road on which a vehicle travels in order to find a sound recording corresponding to this state in an on-board database, making it possible to at least partially mask, by means of an attenuating effect, the characteristic noises released into the passenger compartment and brought about by driving via a loudspeaker. It is understood that such a solution is only effective for driving noises, and also when they conform to a perfectly known road condition, and they cannot be separated in the passenger compartment, at least partially, from all the other sounds present in the environment outside the vehicle.

It is in particular the object of this invention to improve this situation.

SUMMARY

A control device is proposed for this purpose, which device is to equip a vehicle that is to be driven by a driver during a manual control phase and which comprises a passenger compartment equipped with at least one loudspeaker capable of emitting acoustic signals and an assistance device capable of driving the vehicle in a completely autonomous fashion during an autonomous control phase.

This control device comprises:

- acquisition means that can be combined with the vehicle and can record first acoustic signals present in the external environment of the vehicle, and
- control means, operable during an autonomous control phase, to generate second acoustic signals of the opposite phase to the first recorded acoustic signals, and to provide these second acoustic signals to the loudspeaker so that their distribution induces an at least partial cancellation of the first acoustic signals in the passenger compartment.

Because of this active control of the sound cancellation during the autonomous control phases, the passengers of the vehicle are in a quiet environment owing to the fact that they are no longer discomforted by the first acoustic signals.

The control device can have other characteristics that can be adopted separately or in combination, and in particular:

- at the beginning of an autonomous control phase, the control means can individually gradually increase an amplitude of the second acoustic signals to an amplitude that is nearly equal to that of the first acoustic signals recorded in the external environment of the vehicle;
- in a first operating mode (or embodiment), the control means should be able to cease generating second acoustic signals during a transition between an autonomous control phase and a manual control phase;
- in a second operating mode (or embodiment), the control means must be capable of gradually decreasing the amplitude of the second acoustic signals to a null amplitude during a transition between an autonomous control phase and a manual control phase, so that their dissemination makes the first acoustic signals gradually audible in the passenger compartment:
  - the control means can be suitable for applying a progression of the reduction in amplitude based on parameters set by a user of the vehicle;
  - the control means can be used to gradually increase the amplitude of the first recorded acoustic signals to a preset value after having reduced the amplitude of the second recorded acoustic signals to zero, so that these first amplified acoustic signals are broadcast in the passenger compartment by the loudspeaker;
- the control means can be used to actuate the broadcast of at least one preset alarm signal in the passenger compartment by the loudspeaker during a transition phase between an autonomous control phase and a manual control phase;
- the control means can be used to stop generating second acoustic signals during an autonomous control phase in the event of receipt of an order to stop the sound cancellation ordered by a passenger of the vehicle;
- the control means can be used to stop generating second acoustic signals in the event of the receipt of a command to deactivate the sound cancellation issued by a passenger of the vehicle.

A vehicle, such as an automobile, is also proposed that can be driven by a driver during a manual control phase, and that comprises a passenger compartment equipped with at least one loudspeaker that is capable of broadcasting acoustic signals and an assistance device capable of driving the vehicle in a completely autonomous way during an autonomous control phase.

This vehicle is characterized in that it has a control device of the type described above.

DESCRIPTION OF FIGURES

Other characteristics and advantages of the device will come to light upon review of the detailed description below and the attached drawings, in which:

FIG. 1 schematically and functionally illustrates an example of a vehicle comprising an assistance device for autonomous control and an exemplary embodiment of a control device, FIG. 2 schematically illustrates, in a diagram, the temporal evolutions (t) of the amplitudes ($A_{sj}$) of an example of first acoustic signals (S1) recorded outside a vehicle, second acoustic signals (S2) determined by a control device based on these first recorded acoustic signals (S1), and third acoustic signals (S3) that are heard in the passenger compartment of this vehicle in the presence of the first (S1) and the second (S2) acoustic signals, and FIG. 3 schematically illustrates, in a diagram, the temporal evolutions (t) of the amplitudes ($A_{sj}$, j=1 to 3) of an example of first recorded acoustic signals (S1) and third acoustic signals (S3) heard in the passenger compartment of a vehicle, during a manual control phase (pcm), an autonomous control phase (pca) and a transition phase (pt).

DETAILED DESCRIPTION

A control device DC is provided for vehicle VA with autonomous control in order to actively control the sound insulation in the passenger compartment H of the vehicle VA.

A "vehicle with autonomous control" is understood to be a vehicle which comprises an assistance device DA tasked with driving the vehicle without a passenger acting on its steering wheel, and capable of being activated or (at least partially) deactivated in order to allow a driver to drive the vehicle during a manual control phase pcm. Such a vehicle can consequently be optionally steered by a driver during a manual control phase pcm, in a completely autonomous way during an autonomous control phase pca (under control of its assistance device DA), and in an autonomous way followed by a manual control phase pcm during a transition phase pt occurring between an autonomous driving phase pca and a manual driving phase pcm (transferring control from the assistance device DA to the driver).

The assistance device DA ensures control of the autonomous vehicle VA based, in particular, on information relating to the environment outside the autonomous vehicle VA and supplied at least by means of analysis of the external environment stored in the autonomous vehicle VA. To accomplish this, the assistance device DA permanently determines the optimal pathway of the autonomous vehicle VA within the scope of an automated drive, and it controls the steering angle and the speed of the autonomous vehicle VA at the time of each autonomous control phase pca so that the vehicle VA follows the given optimal path as closely as possible.

It is assumed in the following non-limiting example that the autonomous vehicle VA is an automobile. It is, for example, a car. But the invention is not limited to this kind of vehicle. In fact, it concerns any kind of vehicle with autonomous control, and thus not just terrestrial vehicles, but also aircraft and maritime (or river) vehicles, such as for example river taxis.

FIG. 1 schematically and functionally shows an autonomous vehicle VA comprising a passenger compartment H equipped with at least one loudspeaker HP (in this case two) that is able to issue acoustic signals, an assistance device DA that is tasked with driving the autonomous vehicle without a driver operating its steering wheel, and an exemplary embodiment of a control device DC according to the invention.

As shown in FIG. 1, a control device DC at least includes acquisition means MA and control means MC.

It should be noted that the control means MC in the non-limiting exemplary embodiment shown in FIG. 1 is part of a computer C1, which possibly provides at least another functionality within the (autonomous) vehicle VA and which is preferably connected to the communication network of the vehicle VA (possibly of the multiplexed kind and allowing information to be exchanged between on-board electronic devices). But this is not obligatory. The control device DC may in fact include its own computer comprising the control means MC and may be connected to the possible communication network of the vehicle VA. The of control means MC can in addition be implemented in the form of software modules (or "software") or of a combination of circuits or electronic components (or "hardware") and software modules.

The acquisition means MA should be installed in the vehicle VA, outside its passenger compartment H. The acquisition means MA record the first acoustic signals S1 present in the environment outside the vehicle VA. the acquisition means can, for example, include at least one microphone for this purpose. It should be noted that it is advantageous to provide at least two microphones, for example so as to capture a "stereophonic" sound image. In this last case, one can, for example, respectively install them on two lateral sides of the vehicle and/or one at the front of the vehicle and one at the back of the vehicle. Each microphone can, for example, be installed on a bumper (or a windshield) or an external rear view mirror.

The recording is accomplished by numerical sampling.

As soon as numerical samples of the first acoustic signals S1 are recorded, the acquisition means MA transmits them "on the fly" (or in real time) to the control means MC, possibly via the communication network of the vehicle VA.

The control means MC can generate second acoustic signals S2 of the opposite phase with respect to the first recorded acoustic signals S1 during an autonomous control phase pca. The control means MC provides these calculated second acoustic signals S2 to at least one loudspeaker HP that is present in the passenger compartment H of the vehicle VA, so that the emission of the second acoustic signals S2 induces an at least partial cancellation of the first acoustic signals S1 present outside and normally audible to the passengers in the absence of these second acoustic signals S2 in the passenger compartment H.

In other words, during an autonomous control phase pca, the control means MC produces second acoustic signals S2, the combination (or superposition) of which with the first acoustic signals leads to third acoustic signals S3 whose amplitude $A_{s3}$ is almost flat in time (t) and close to zero (0), as illustrated schematically in the example of FIG. 2. This at least partial cancellation of the first acoustic signals S1 derives from the fact that the acoustic signals are pressure waves, and the combination (or superposition) of two pressure waves of perfectly opposite phases and having similar amplitudes thus induces opposite pressures which thus cancel each other. It should in fact be recalled that when two waves have opposite phases, the maximum of one coincides temporally with the minimum of the other and vice versa, so that these two waves cancel each other. This wave-related mechanism, allowing for the sound insulation of the passenger compartment H with respect to the environment outside the vehicle VA, is illustrated in FIG. 2.

The passengers of the vehicle VA thus find themselves in a calm environment during the autonomous control phase pca, owing to the fact that they are no longer bothered by the first acoustic signals S1, which allows them to benefit from the totality of the advantages they offer.

It should be noted that the control means MC can be used to gradually increase the amplitude $A_{s2}$ of the second acoustic signals S2 determined at the beginning of an autonomous control phase pca until it is approximately equal to the amplitude $A_{s1}$ of the first acoustic signals S1 recorded in the external environment of the vehicle VA. This allows quiet to be introduced gradually in the passenger compartment H, rather than imposing this quiet suddenly (when the amplitude $A_{s2}$ of the second determined acoustic signals S2 is immediately nearly equal to the amplitude $A_{s1}$ of the first recorded acoustic signals S1, which is a possible alternative).

This procedure of establishing quiet progressively is illustrated in the middle part of the diagram of FIG. 3. It should indeed be noted that the third acoustic signals S3 resulting from the superposition of the first S1 and the second S2 acoustic signals, have a wave form that is virtually identical to that of the first acoustic signals S1 recorded, while having an amplitude $A_{s3}$ that gradually decreases to a value that is close to zero.

It should be noted that the control methods MC can be used to impose a progressiveness to the increase in amplitude $A_{s2}$ (of the second acoustic signals S2), based on parameters set beforehand by a user of the vehicle VA. Progressiveness can, for example, be parameterized in the area of the length of time used for increasing towards a maximum amplitude $A_{s2}$ (and thus towards a minimal output amplitude $A_{s3}$) and/or the shape of the increase (for example linear or with $x^n$ (with $n \geq 2$) or exponential).

It should also be noted that the control means MC can be informed by the assistance device DA of the driving phase in which their vehicle VA happens to be at the moment (pca, pt or pcm), either via a direct connection between the computer C1 and the assistance device DA, or indirectly via another computer and/or the possible communication network of the vehicle VA.

At least two operating modes can be considered at the time of the transition phases pt between an autonomous phase of control pca and a manual control phase pcm.

In a first operating mode, the control means MC can be used to cease generating second acoustic signals S2 during a transition phase pt between an autonomous control phase pca and a manual control phase pcm.

In other words, as soon as the control means MC is informed of the start of such a transition phase pt in this first operating mode, it immediately stops generating (and thus calculating) second acoustic signals S2, so that the passengers of the vehicle VA hear the first acoustic signals S1 present in the environment outside of the vehicle VA normally and immediately. The driver is thus immediately reintegrated in the road environment (which may have changed completely compared to that which prevailed at the beginning of the autonomous control phase pca, which has just ended) from the very start of the transition phase pt.

In a second operating mode, the control means MC can be used to gradually decrease the amplitude of the second acoustic signals S2 that are set to a zero amplitude during a transition phase pt between an autonomous control phase pca and a manual control phase pcm, so that their emission renders the first acoustic signals S1 present in the environment outside the vehicle VA gradually audible in the passenger compartment H. The driver is thus gradually reintegrated in the road environment (which may have changed completely compared to that which prevailed at the beginning of the autonomous control phase pca, which has just ended) during the transition phase pt, so that he can manage the resumption of control of his vehicle VA without being surprised by events on the road.

This situation is illustrated in the right-hand part of the diagram of FIG. 3. It should indeed be noted that the third acoustic signals S3 resulting from the superposition of the first S1 and second S2 acoustic signals have a wave form that is virtually identical to that of the first acoustic signals S1 while having an amplitude $A_{s3}$ which increases gradually until it reaches an amplitude that is slightly lower than that of the first acoustic signals S1 (since S3 is measured in the passenger compartment H whereas S1 is measured outside the passenger compartment H).

It should be noted that the control means MC can be used to apply a gradual reduction in amplitude $A_{s2}$ (of the second acoustic signals S2) based on parameters set beforehand by a user of the vehicle VA. The gradualness can, for example, be parameterized in the time domain used for tending towards a minimal amplitude $A_{s2}$ (and thus towards a maximum amplitude $A_{S3}$) and/or the shape of the reduction (for example linear or with $x^n$ (with $n \geq 2$) or exponential). This is only a nonrestrictive example implementation, for many other possible parameter settings can be considered.

It should also be noted that the control means MC can be used to not generate second acoustic signals S2 during a manual control phase pcm, so that the driver hears the first acoustic signals S1 present in the outside environment of the vehicle VA normally. This situation of nonintervention is illustrated in the left part of the diagram of FIG. 3. It should indeed be noted that the third acoustic signals S3 heard by the passengers of the vehicle VA derive only from the first acoustic signals S1 present in the environment outside the vehicle VA. Their wave form is identical to that of the first acoustic signals S1, while their amplitude $A_{s3}$ is slightly lower than the amplitude $A_{s1}$ of the first outside acoustic signals S1 because of passive sound insulation of the passenger compartment H conferred by its construction. One can plan to use a threshold that is not to be exceeded for the sound insulation at the time of a manual control phase.

It should also be noted that the control means MC can be used to gradually increase the amplitude of the first recorded acoustic signals S1 up to a preset value after having nullified the amplitude $A_{s2}$ of the second recorded acoustic signals S2, so as to generate first amplified acoustic signals which are emitted by (each) loudspeaker HP in the passenger compartment H. In other words, the control means MC will cause the first acoustic signals S1' whose wave form is identical to that of the first acoustic signals S1 recorded in the outside environment of the vehicle VA, in order to increase the amplitude of the first acoustic signals S1 to be released into the passenger compartment H. The driver is then, in a manner of speaking, quite temporarily immersed in the environment of the road, just as if he were outside of his vehicle VA in order to again become aware of the latter.

It should also be noted that the control means MC can be used to start the broadcast by (each) loudspeaker HP of at least one preset alarm signal in the passenger compartment H during a transition phase pt between an autonomous control phase pca and a manual control phase pcm. This alarm signal is intended to alert the driver of the fact that the assistance device DA will again hand over control of the vehicle VA to him and of the possible presence of a hazard having been detected in the outside environment (such as, e.g., a course deviation by another vehicle or the presence of a cyclist or a pedestrian in the immediate vicinity). This alarm signal can be a dedicated melody (or an acoustic signal) or a synthesized vocal message (for example reminding the driver of actions he must take and/or of a detected hazard).

It should also be noted that the control means MC can be used to cease generating (and thus calculating) second acoustic signals S2 during an autonomous control phase pca in the event of the reception of an order to cease stopping the acoustic insulation supplied by a passenger of the vehicle VA via a man/machine interface. This option is intended to require the control device DC to temporarily cease suspending the first acoustic signals S1 during the autonomous control phase pca in progress. The command can be entered by selecting an option in a menu posted on a screen of the vehicle VA (e.g., belonging to a center screen) or by pressing on a control unit or also by issuing a dedicated expression (such as, e.g. "stop acoustic insulation").

It should also be noted that the control means MC can stop generating (and thus stop calculating) second acoustic signals S2 in the event of the reception of an order to deactivate active sound insulation provided by a passenger of the vehicle VA. This option is to require the control device DC to permanently cease actively controlling the first acoustic signals S1 regardless of the control phase being considered. The command can be supplied by selecting an option in a menu posted on a screen of the vehicle VA (for example belonging to a central screen) or else by pressing on a control unit or by issuing a dedicated verbal command (such as, e.g. "deactivate acoustic insulation").

The invention claimed is:

1. A control device for a vehicle that can be driven by a driver during a manual control phase and comprises a passenger compartment equipped with at least one loudspeaker that is capable of emitting acoustic signals and an assistance device that is capable of driving the vehicle completely autonomously during an autonomous control phase, wherein the control device includes i) acquisition means that can be part of the vehicle and can record first acoustic signals present in the environment external to said vehicle, and ii) control means that can be used during an autonomous driving control phase to generate second acoustic signals of the opposite phase with respect to said first recorded acoustic signals, and to supply these second acoustic signals to a loudspeaker so that their emission induces an at least partial cancellation of said first acoustic signals in said passenger compartment; wherein said control means can be used to gradually increase the amplitude of the second acoustic signals at the beginning of said autonomous control phase, to an amplitude that nearly equals an amplitude of the first acoustic signals recorded in said environment outside of the vehicle.

2. The control device according to claim 1, wherein said control means is able to cease generating second acoustic signals during a transition phase between said autonomous control phase and said manual control phase.

3. The control device according to claim 1, wherein said control means can gradually decrease an amplitude of the second acoustic signals to a zero amplitude, during a transition phase between said autonomous control phase and said manual control phase, so that their emission makes said first acoustic signals gradually audible in said passenger compartment.

4. The control device according to claim 3, wherein said control means can be used to apply a gradual reduction in the amplitude based on parameters set by a user of said vehicle.

5. The control device according to claim 3, wherein the control means can be used to gradually increase the amplitude of said first recorded acoustic signals to a preset value, after having reduced said amplitude of the second acoustic signals to zero, so that these first amplified acoustic signals are broadcast into said passenger compartment by said loudspeaker.

6. The control device according to claim 1, wherein said control means can be used to start broadcasting of at least one preset alarm signal by said loudspeaker into said passenger compartment during a transition phase between said autonomous control phase and said manual control phase.

7. A vehicle that can be driven by a driver during a manual control phase, the vehicle comprising a passenger compartment equipped with at least one loudspeaker capable of broadcasting acoustic signals and an assistance device capable of steering said vehicle in a completely autonomous manner during said autonomous control phase, wherein, said vehicle includes said control device according to claim 1.

8. A control device for a vehicle that can be driven by a driver during a manual control phase and comprises a passenger compartment equipped with at least one loudspeaker that is capable of emitting acoustic signals and an assistance device that is capable of driving the vehicle completely autonomously during an autonomous control phase, wherein the control device includes i) acquisition means that can be part of the vehicle and can record first acoustic signals present in the environment external to said vehicle, and ii) control means that, based on said vehicle being in said autonomous control phase, generates second acoustic signals of the opposite phase with respect to said first recorded acoustic signals, and to supply these second acoustic signals to a loudspeaker so that their emission induces an at least partial cancellation of said first acoustic signals in said passenger compartment;

wherein said control means can be used to cease generating second acoustic signals in the event of the receipt of an order to stop sound cancellation during said autonomous control phase ordered by one of said passengers of said vehicle.

9. A control device for a vehicle that can be driven by a driver during a manual control phase and comprises a passenger compartment equipped with at least one loudspeaker that is capable of emitting acoustic signals and an assistance device that is capable of driving the vehicle completely autonomously during an autonomous control phase, wherein the control device includes i) acquisition means that can be part of the vehicle and can record first acoustic signals present in the environment external to said vehicle, and ii) control means that, based on said vehicle being in said autonomous control phase, generates second acoustic signals of the opposite phase with respect to said first recorded acoustic signals, and to supply these second acoustic signals to a loudspeaker so that their emission induces an at least partial cancellation of said first acoustic signals in said passenger compartment;

wherein said control means ceases to generate second acoustic signals upon receipt of an order to deactivate the sound cancellation issued by a passenger of said vehicle.

* * * * *